US005480154A

United States Patent [19]

Barnhill et al.

[11] Patent Number: 5,480,154

[45] Date of Patent: Jan. 2, 1996

[54] GOLF BALL INCLUDING SOUND-EMITTING MEANS

[76] Inventors: William R. Barnhill, 1750 Orchard Rd., Mooresville, Ind. 46158; Jerry D. Weddell, 10 Kentucky Ave., Clayton, Ind. 46118; Dave Smitson, 1660 Cottonwood Ct., Plainfield, Ind. 46168

[21] Appl. No.: 334,950

[22] Filed: Nov. 7, 1994

[51] Int. Cl.[6] ..... A63B 43/00

[52] U.S. Cl. ..... 273/213

[58] Field of Search ..... 273/213, 187.3, 273/58 G

[56] References Cited

U.S. PATENT DOCUMENTS 5,112,055 5/1992 Barnhill ..... 273/213

*Primary Examiner*—George J. Marlo
*Attorney, Agent, or Firm*—Robert A. Spray

[57] ABSTRACT

A golf ball having internal parts which provide sound-emission upon the ball being struck, the sound continuing until the ball is found and the golfer releases the actuation switch, that action also cocking the device for the next golf shot which re-starts the sound-emission.

The sound-emission parts are all carried internally by the ball body; and they include an electric sound-emitter, a movable carrier member, a metallic inner cap for the carrier member, and a metallic actuator member. A spring both biases them into sound-emission contact and also serves as a conductor in the sound-emitter circuit. Frictional and releasable holding means provide for establishing and maintaining a sound-silent condition, against the bias of the spring.

An actuator tool is provided, having both an actuator shaft and a torque lug, for convenience of manual actuation of the device details.

24 Claims, 5 Drawing Sheets

GOLF BALL INCLUDING SOUND-EMITTING MEANS

FIELD OF THE INVENTION

The present invention relates to golf balls, and more particularly to golf balls having signal-emitting means carried by the golf ball for providing help in finding a ball which has been lost.

The problem of lost golf balls, as due to a misdirected hit of the ball into an area of trees, bushes, leaves, etc., has been a problem of golfers for many years; and the loss of a ball is not only a loss of the value of the ball, but also causes a waste of time in searching for the ball, all as is well known.

SUMMARY OF THE PRESENT INVENTION

The sound-emitting golf ball device carries as internal parts a movable carrier member, a metallic inner cap for the carrier member, and a metallic actuator member carried in a recess of the carrier member.

A spring biases the actuator member into electric contact with the cap member, those two parts serving as a switch in the sound-emitter circuit.

The spring, formed of metal, itself serves as a conductor between the actuator member and a conductive body which is biased by the spring to forcefully engage a battery, that spring effort also forcing the battery against a terminal conductor from a sound-emitter device, the circuitry being closed by a wire from the opposite terminal of the sound-emitter device being held by the carrier member for electrically contacting the cap member.

Alternative conductive body features are provided.

Frictional and releasable holding means are also provided by the adjacent portions of the actuator member and the carrier member, for establishing and maintaining a sound-silent condition, but also releasable for providing when released a shock-activation of the switch, by the striking of the ball by a golf club, which closes the switch by the then-unopposed spring force, beginning sound-emission; and the sound continues during the ball-flight and the resting of the ball.

The golfer, upon finding the ball, by a single manual effort pushes the actuator member to both open the switch and establish the sound-silent open-circuit condition of the switch, that silence being held by the holding means until the subsequent time when the ball is next impacted, releasing the holding means and re-closing the switch.

A novel actuator tool is provided, having both an actuator shaft and a torque lug, for convenience of release of the switch-closure and for opening and closing the ball's closure cap for the chamber which contains the sound device components.

More details are specified in the more detailed description herein.

Prior Art Capability and Motivations, as Helping to show patentability here:

Although the closest prior art to the present inventive concepts is probably to be considered as the sound-emitting golf ball of one of the present inventors (Barnhill, William R., U.S. Pat. No. 5,112,055, granted May 12, 1992), it is quite realistically to be mentioned that there have been surely many millions of rounds of golf played since that patent was issued, and the manufacturers of golf balls are in a quite competitive field; and thus the likelihood of possible inventors knowing of the Barnhill invention is quite high in spite of the relative recency of that patent's issuance. Moreover, as noted below, the prior art in the field prior to that Barnhill invention was quite voluminous; and thus the world's inventorship subsequent to the Barnhill invention has been more than ample to have made this present invention, if it had the creativity and inventorship shown by the present invention.

Even in hindsight consideration of the present invention to determine its inventive and novel nature, it is not only conceded but emphasized that the prior art had many details usable in this invention, but only if the prior art had had the guidance of the present concepts of the present invention, details of both capability and motivation.

That is, it is emphasized that the prior art had/or knew several particulars which individually and accumulatively show the non-obviousness of this combination invention. E.g., a. Substantially all of the operational characteristics and advantages of details of the present invention, when considered separately from one another and when considered separately from the present invention's details and non-technical accomplishment of the details, are within the skill of persons and many business entities of various arts, but only when considered away from the integrated and novel combination of concepts which by their cooperative combination achieves this advantageous invention.

b. The details of the present invention, when considered solely from the standpoint of construction, are exceedingly simple; and the matter of simplicity of construction has long been recognized as indicative of inventive creativity.

c. Similarly, and a long-recognized indication of invention of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate.

d. The prior art has long had mechanisms of various types which could produce all the particulars of the present invention.

e. The prior art knows the advantages of lower manufacturing costs in combination with a workable product and process.

f. The prior art has long had the problem of lost golf balls, even if only partly obscured by terrain features.

g. The prior art has long known of the disadvantages of "slow play" by golfers on a busy golf course, with increasing instances of golf course administrators imposing penalties against slow players.

h. The prior art has even had all of the sound-emitting apparatus details and component-forming machinery and procedures and ability which could have been used to provide the advantageous sound-emitting device of the present invention, but only if the prior ark had had the concepts.

i. The sales incentive for a golf ball like this would likely seem to be high to manufacturers in this or comparable fields, for golf is played in a setting of a plurality of players, fellowship, and clubs, which would likely seem to the manufacturers to likely multiply many sales opportunities and incentives; and there are millions of golfers who would be assumed to easily afford and willingly pay the price of these balls, whether purchased as a useful equipment item or even from a novelty aspect.

In spite of all such factors of the prior art, the problem here solved awaited this invention's creativity. More particularly, as to the novelty here or the invention as considered as a whole, a contrast to the prior art helps show its contrast to the present concepts, and emphasizes the advantages and the inventive significance of the present concepts as are here shown, and the nature of the concepts and their results can perhaps be easier understood.

In addition to the prior art shown by the cited Barnhill patent, earlier prior art shown by searches of the prior art made after that invention included all of the following, but all of these failed to show a combination of details to the present invention; and a realistic consideration of the prior art's several differences from the present concepts may more aptly be described as teaching away from the present invention's concepts, in contrast to suggesting them, even as to a hindsight attempt to perceive suggestions from a backward look into the prior art. Those prior art examples are:

P. S. Kane, U.S. Pat. No. 1,583,721, May 4, 1926;
A. J. Rubin, U.S. Pat. No. 1,620,290, Mar. 8, 1927;
S. J. Bens, U.S. Pat. No. 1,664,397, Apr. 3, 1928;
F. Veatch, U.S. Pat. No. 2,861,810; Nov. 25, 1958;
C. J. Smith et al., U.S. Pat. No. 3,351,347, Nov. 7, 1967;
A. P. Pedrick, 1,121,630, Jul. 31, 1968 (British);
A. C. Wickman, 1,172,449, Nov. 26, 1969 (British);
Horchler, U.S. Pat. No. 3,782,730, Jan. 1, 1974;
Ratkovich, U.S. Pat. No. 3,790,948, Feb. 5, 1974;
Miller et al., U.S. Pat. No. 4,065,537, Dec. 27, 1977;
A. W. Ready, 1,530,266, Oct. 25, 1978 (British);
Yamada, U.S. Pat. No. 4,625,964, Dec. 2, 1986;
Barricks et al., U.S. Pat. No. 4,660,039, Apr. 21, 1987;
Newcomb et al., U.S. Pat. No. 4,695,055, Sep. 22, 1987;
Sahr, Ingrid, 3,609,016, Sep. 24, 1987 (German);
Schooler et al., 2,188,415, Sep. 30, 1987 (British);
Schooler et al., 2,188,554, Oct. 7, 1987 (British);
L. D. Brailean, U.S. Pat. No. 4,749,198, Jun. 7, 1988;
M. Weber, 3,732,762, Apr. 6, 1989 (German);

"Beacon" advertisement cites the Brailean U.S. Pat. No. 4,749,198 in September 1990 issue of *Deer & Deer Hunting*, p. 81 and other non-numbered pages; "Sound Tracker" advertisement by Sporting Technologies, Inc., in *Bowhunting World* p. 143, Fall 1990, an arrow locator.

As to each of the above, a brief description is given in the above-cited Barnhill patent; and, as to the following prior art, these were merely cited in the Patent Office's determination that the earlier Barnhill golf ball (of that patent) was an inventive advance over the prior art.

Hendry, U.S. Pat. No. 3,804,411, April 1974;
Potrzuski, U.S. Pat. No. 3,935,669, February 1976;
Newcomb et al., U.S. Pat. No. 4,002,893, January 1977; and
Murphy, U.S. Pat. No. 4,421,319, December 1983.

Accordingly, although the prior art has had capability and motivation, amply sufficient to presumably give incentive to the development of a sound-emitting golf ball with novel circuitry according to the present invention, the fact remains that the present invention has awaited the present creativity and inventive discovery of the present invention. In spite of ample motivation and capability shown by the many illustrations herein, the prior art did not suggest this invention.

Summary of the Prior Art's Lack of Suggestions of the Concepts of the Invention's Combination In spite of all such factors of the prior art, the problem here solved awaited this present invention's creativity. More particularly as to the novelty here of the invention as considered as a whole, the resume, of the prior art uses and needs, helps show its contrast to the present concepts, emphasizes the advantages, novelty, and the inventive significance of the present concepts as are here shown, particularly as to novel circuitry and functioning of components.

Moreover, prior art articles known to these inventors which could possibly be adapted for this duty, fail to show or suggest the details of the present concepts as a combination; and a realistic consideration of the prior art's differences from the present concepts of the overall combination may more aptly be described as teaching away from the present invention's concepts, in contrast to suggesting them, even as to a hindsight attempt to perceive suggestions from a backword look into the prior art, especially since the prior art has long had much motivation as to details of the present invention and to its provisions.

And the existence of such prior art knowledge and related articles embodying such various features is not only conceded, it is emphasized; for as to the novelty here of the combination, of the invention as considered as a whole, a contrast to the prior art helps also to remind both the great variety of the various prior art articles and needed attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier understood.

Although varieties of prior art are conceded, and ample motivation is shown, and full capability In the prior art is conceded, no prior art shows or suggests details of the overall combination of the present invention, as is the proper and accepted way of considering the inventiveness nature of the concepts.

That is, although the prior art may show an approach to the overall invention, it is determinately significant that none of the prior art shows the novel and advantageous concepts in combination, which provides the merits of this invention, even though certain details are shown separately from this accomplishment as a combination.

And the prior art's lack of an invention of a sound-emitting golf ball achieving the convenience, parts-functioning, simplicity, and other advantages of the present invention, which are goals only approached by the prior art, must be recognized as being a long-felt need.

Accordingly, the various concepts and components are conceded and emphasized to have been widely known in the prior ark as to various devices; nevertheless, the prior ark not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing the inventive concepts; and in the drawings:

FIG. 2, is a fragmental detail view like FIG. 2 except that FIG. 4 is showing the switch having been pushed to switch open position, the parts also being shown as releasably held in a cocked condition for later switch-closure upon impact of the ball by a golf club to start (or re-start) the sound-emitting condition as illustrated in FIGS. 1 and 2;

SUMMARY OF COMPONENTS

Figure 1:
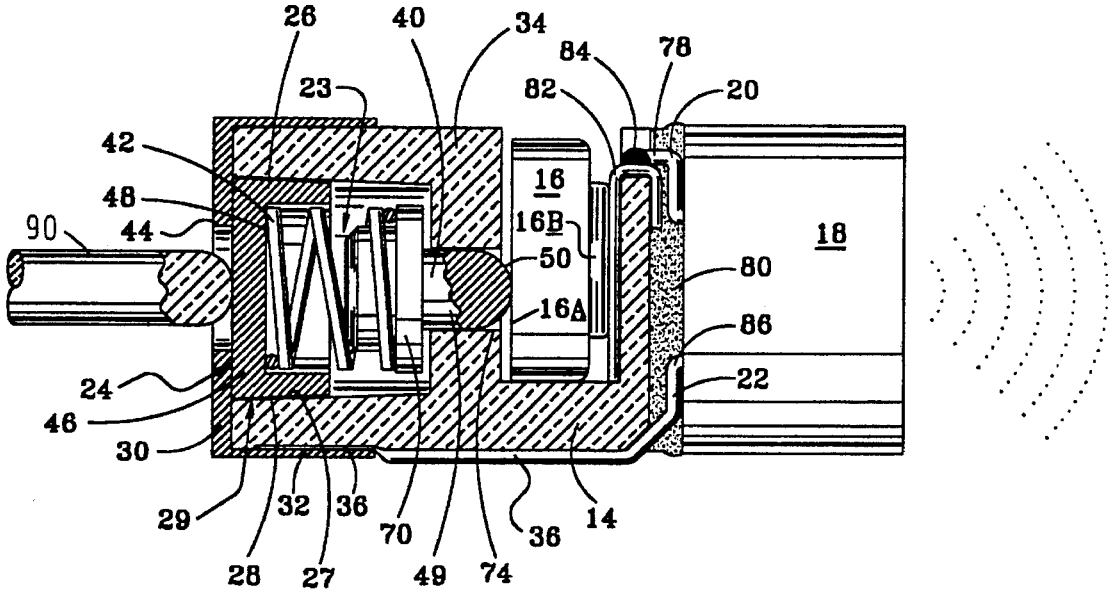
FIG. 1 is a cross-sectional view of the inner parts of the sound-emitting golf ball of the present invention, the switch being shown in closed condition, and with a sound-silencing actuator ready to be pushed to open the switch, this view being of a 1st Embodiment.

A summary of the prominent features is as follows, somewhat oversimplified for convenience of references:

10 overall device
12 ball body
14 carrier member
15 body core
16 battery
18 sound emitter
20, 22, 23 circuitry
24 switch means
26 movable actuator
29 retention means
30 inner cap
40 conductive member
42 spring
52 shock absorber
53 (64) control outlet end of bore 15
54 (58) installation end of bore 15
56 outer closure cap
90 manual actuator tool
96 female screw threads
98 male screw threads
100 wall of 14

DETAILED DESCRIPTION OF ILLUSTRATIVE EMBODIMENTS

The Drawings illustrate preferred embodiments of a golf ball device 10 which is sound-capable as a sound-emitting device for finding the golf ball 10 when lost.

As shown, the overall device 10 (FIGS. 5 and 6) resembles a conventional golf ball, the sound-emitting components being internally of the golf body 12; and the combination (FIGS. 1, 6, and 11) is specified as per the illustrative embodiments shown.

A carrier member 14, electrically non-conductive, is carried by the golf ball body 12 interiorly, in a cylindrical body hole 15 as a primary receiving chamber 15 of the ball body 12.

Electric power is provided by a battery 16 for an electrically energizable sound-emitting means 18, a so-called "buzzer" or other tone or sound-emitting electric signal device 18 here generally referred to often merely by the word "buzzer" 18.

The buzzer 18 is shown as having operative circuitry here called a first electric circuitry means 20 and a second electric circuitry means 22. These circuits activate the sound-emitting buzzer 18 when impressed with different voltage, of course a well known basic electrical operativity.

There is electric circuitry 23 described herein as to its features, operatively connecting the respective ones of the first electric circuitry means 20 and the second electric circuitry means 22, and their conducting components, in series, with one another and with the buzzer 18 and the battery 16.

(For facilitating the description of details of the overall circuitry, and even though series-circuitry may be considered as actually a single circuit, the overall circuitry is arbitrarily divided for descriptive purposes as follows: circuit means 20 leading to or from the battery 16 to the buzzer 18, and circuit means 22 leading to or from the buzzer 18 toward the switching means 24, and with circuitry referred to as circuitry 23 in series with those circuit means 20 and circuit means 22. It should be thus realized that it is just arbitrary, for descriptive purposes, to designate features as being "in" a particular one or other of the circuitry 20, 22, or 23.)

Also there is a specially operative switch means 24 described below, in operative series with the battery 16 and the buzzer 18 circuitry, i.e., its circuitry 23 and first electric circuitry means 20 and second electric circuitry means 22.

For operativity shown below, a movable and generally cylindrical metal actuator member 26, with generally cylindrical outer walls 27, is movably carried by the carrier member 14 in a generally cylindrical chamber 28 provided in the carrier member 14, the chamber 28 and wall 27 being generally co-axial, except as to some taper specified below, as providing a releasable holding means 29.

As shown, there is a metal cap member 30, in the form of a hollow cylinder having a cylindrical wall 32, connected into a mechanical assembly with the carrier member 14, by the wall 32 snugly fitting and/or adhesively connected to the carrier 14's outer wall 34; and the series circuitry 23 through the buzzer 18 is provided in part by the conductive portions of the assembly of carrier member 14 and cap 30 having electrically conductive means shown as wire 36 connected to cap wall 32 and to one (here 22) of the first electric circuitry means 20 and second electric circuitry means 22 of the sound-emitting means or buzzer 18.

That connection of wire 36 to the cap wall 32 is shown as by a snug fit of the cap wall 32 onto the carrier member 14's wall 34, that tight fit providing ample conductivity between the wire 36 and the cap wall 32.

Figure 2:
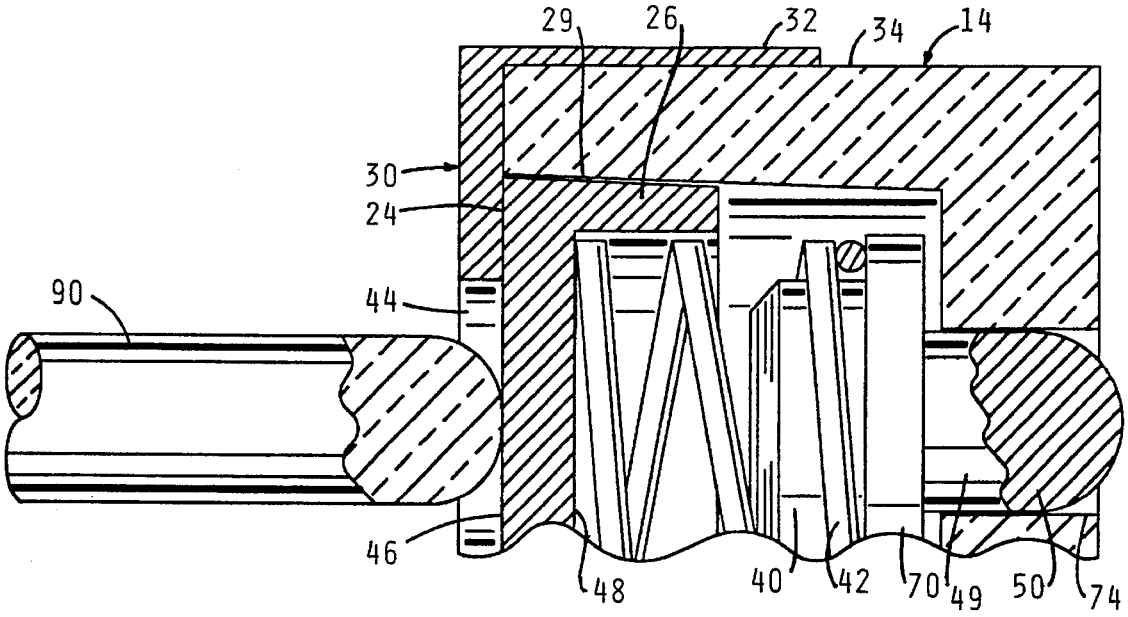
FIG. 2 is an enlarged detail view of that shown in FIG. 1, particularly for illustrating the switch components in switch-closed condition.
Figure 11:
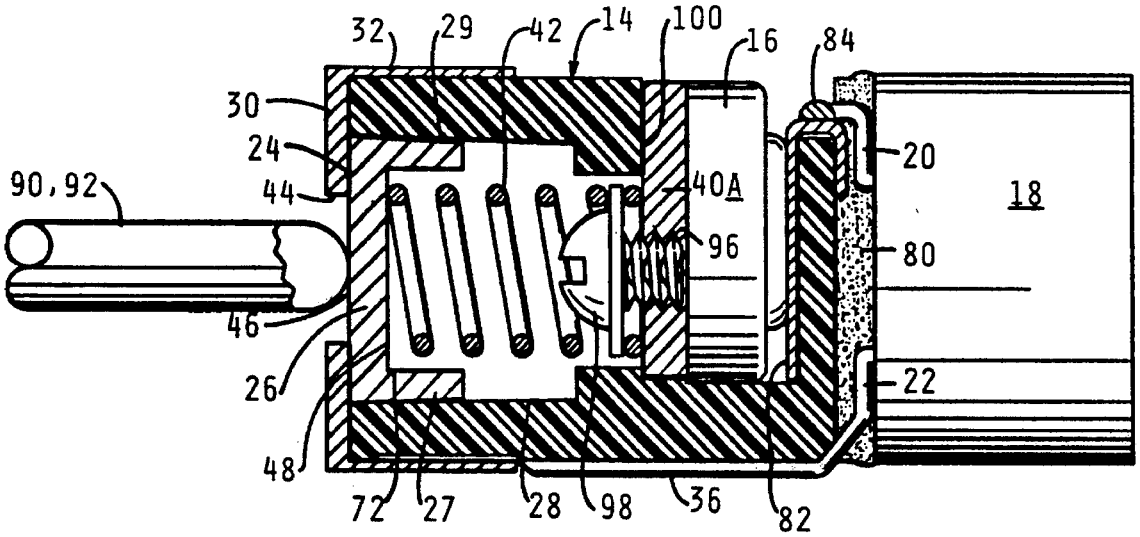
FIG. 11 is a view of the invention according to a 2nd Embodiment, showing the inner parts of the sound-emitting golf ball as in FIG. 1, i.e., the switch being shown in closed (sound-emitting) condition, and with a sound-silencing actuator ready to be pushed to open the switch.

As mentioned, the actuator member 26 and the carrier member/cap member assembly (14/30) are relatively movable, this being movement into and between a sound-silent condition, in which the switch means 24 is in an open-circuit condition, and a sound-emitting condition (FIGS. 1 and 2) in which the switch means 24 is in a closed-circuit condition, as it is in FIG. 11 (2nd Embodiment).

Figure 3:
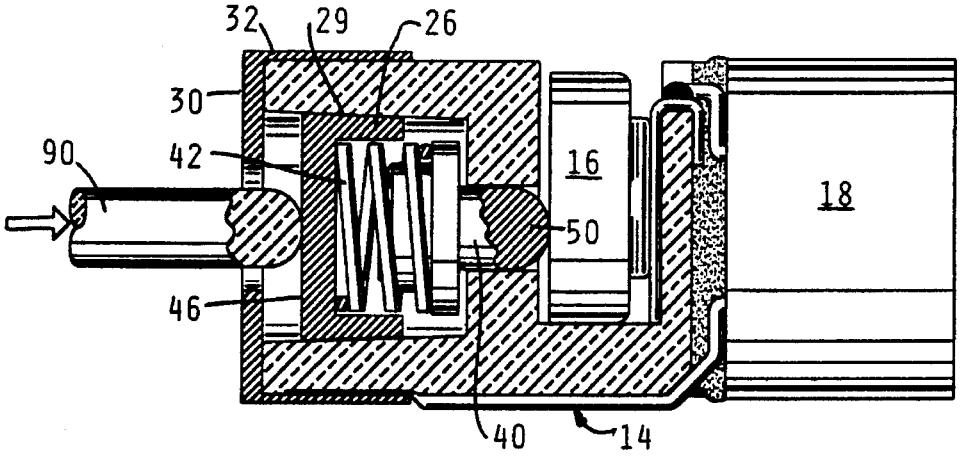
FIG. 3, generally in the same scale as FIG. 1, is a view like FIG. 1, except with the switch being shown as being pushed to switch-open condition.
Figure 4:
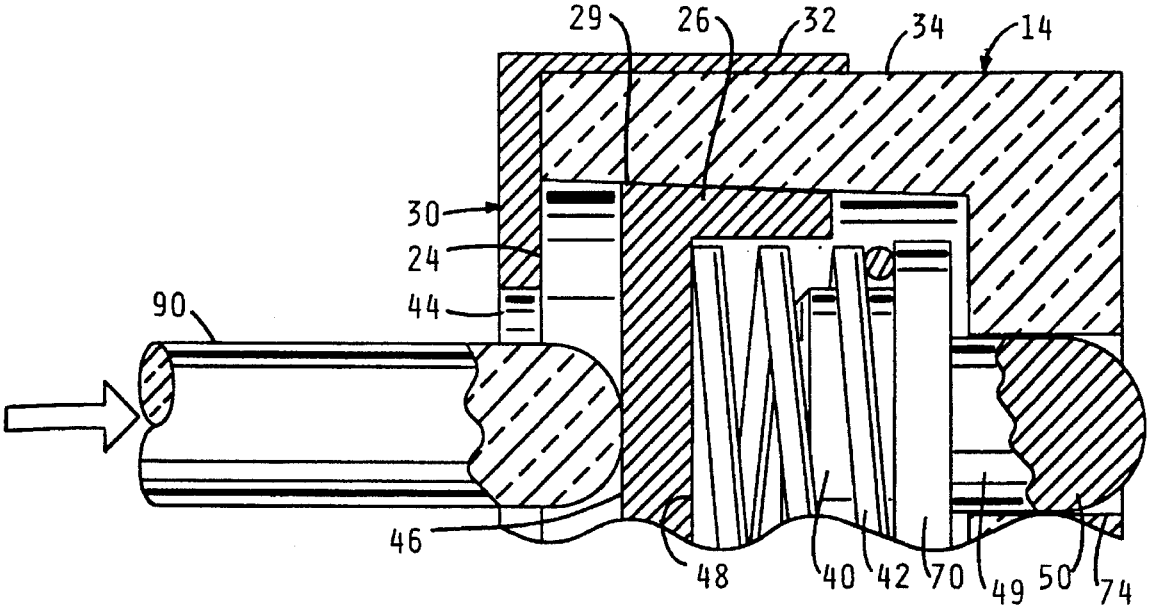
FIG. 4, enlarged as per
Figure 6:
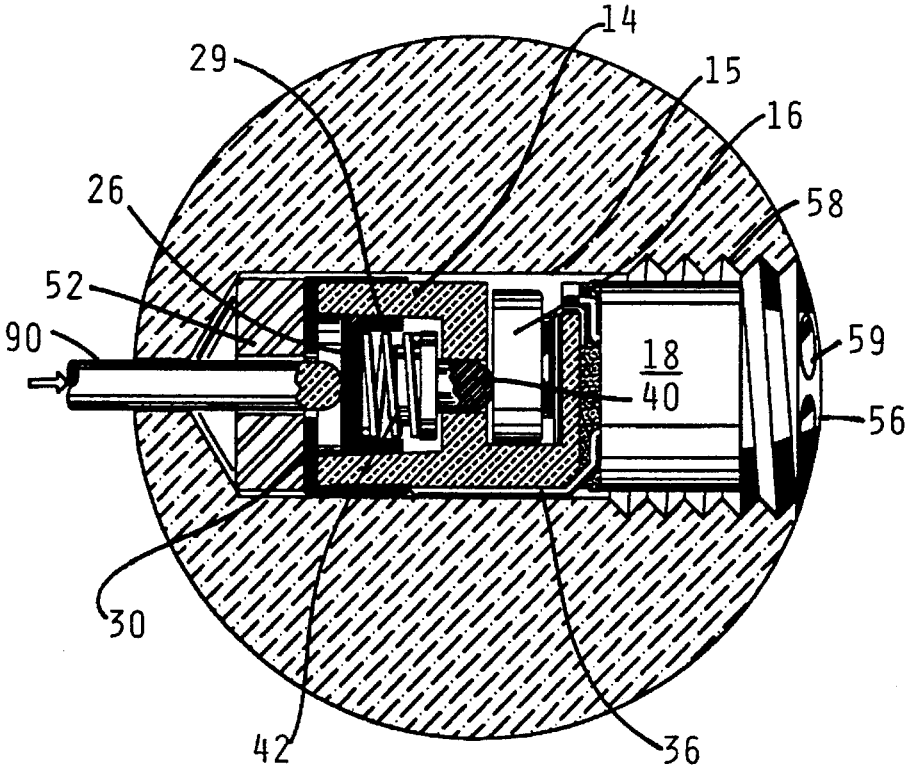
FIG. 6 is an axial cross-sectional view of the overall ball, and containing all of its inner parts and features, and with an actuator having been manually pushed cause the switch to be in switch-open (cocked) condition, and with a cap affixed to the ball body.

The switch 24 operativity is provided by a movable relation of the cap member 30 and cap wall 32 having electrically conductive means (here the metal of the cap 30 and cap wall 32) and the movable actuator member 26, i.e., a movable relation such that in what might be called a "first relative position" they (cap 30 and actuator 26, FIGS. 1,2,11) have a closed-circuit or operatively touching condition, and providing circuitry 23 closure by electrical contact therebetween, whereas when they are in a "second relative position" they are operatively in an open circuit condition, not operatively touching, and thus not providing electrical contact therebetween for closure of circuitry 23, as per FIGS. 3, 4, and 6.

Also carried by and in the carrier 14 is a conductive body member 40 with operativity mentioned below, and a spring means 42 which operatively interconnects the conductive body member 40 and the movable actuator member 26, the spring 42's ends biasing them apart for two effects: (a.) biasing the movable actuator member 26 toward the cap 30 and thus the components 26/30 to their first relative position having sound-emitting (closed-circuit 23) condition of the switch means 24 (and maintaining that sound-emitting condition as described below, until opposing force is exerted as specified below as being a sound-stopping actuation by the user),and (b.) forcing the conductive body member 40 into tight contact with battery terminal 16A, the positive battery terminal, and this in turn acting to forcefully push the battery 16 (and its negative terminal 16B) tightly against the circuit wire 20 leading to/from the buzzer 18.

Sound-stoppage capability is of course desired; and there are provided releasable holding means 29 operative to maintain the carrier member/cap member assembly (14/30) and the movable actuator member 26 in a relative non-touching (FIGS. 3,4 and 6) open-circuit position which maintains the sound-silent condition of the switch means, this being by the taper of one or both (FIG. 2) of actuator wall 27 and chamber wall 28. (Silence is maintained until the ball 10/12 is struck, as explained below.)

The releasable holding means 29, by impact of a golf club upon the ball 10/12, from the left in FIG. 6, permits the spring means 42, in opposition to the retention of sound-silent condition by holding means 29 (27/28), to cause the movable actuator member 26 and the carrier member/cap member assembly 14/30 to move relatively toward one another, achieving sound-emitting condition of the switch means 24, i.e., by engagement of 26/30 components. (FIGS. 1 and 2 of the 1st Embodiment, and FIG. 11 of the 2nd Embodiment.)

Desirably, and in the forms shown, the spring means 42 not only provides the plural-effect biasing operativity mentioned above, but also itself serves as the conductor of electrical energy between the movable actuator member 26 and the conductive body member 40.

As shown, the inner cap 30 is provided with an inner cap aperture 44 which provides operative access through the cap member 30 to reach the movable actuator member 26 for opening the switch 24's contacts 26/30 by release of the holding means 29 (27/28), i.e., by the user's manual force to be operatively applied as a push to the movable actuator member 26 to achieve silencing of the sound-emitting buzzer means 18, but also to cock the device. That action serves to both establish the releasably-held silent condition of the releasable holding means 29, i.e., to establish and maintain the open-circuit 23 silence of the buzzer 18, but also to cock the device 12(FIGS. 3, 4, and 6) for the subsequent impacting of the ball 10/12 by a golf club to re-start the closed-circuit 23 sound-emitting operativity of the buzzer 18, both silencing and cocking effects achieved by a single manual force action of the user, illustrated in FIGS. 3,4, and 6.

As a part of the switch means 24 the movable actuator 26 is metal, at least as to having electrical conductivity substance on a first face of the movable actuator member 26 which, when the carrier member 14 is disposed in the golf ball 12, is the movable actuator member 26's face 46 facing the direction (here left) which the movable actuator member 26 is being biased by the spring means 42.

The movable actuator member 26, being here metal, also has electrical conductivity means on its opposite or second face 48, that being the face 48 which has electrical conductivity means in electrical conductivity contact with the spring means 42, with the metal of the movable actuator body 26 providing its own electrical conductivity operatively between the electrical conductivity means on its first and second faces 46/48.

The overall electric circuitry 23 is thus to be seen as including portions which provide switch-terminal components 30 of the switch means 24 which are operatively in electrically conductive engagement with the electrical conductivity means on the first face 46 of the movable actuator member 26 when the movable actuator member 26 is released from the sound-silent condition of the switch means 24, that release being the action of the golf club striking the ball 10/12 (from the left, FIGS. 5 and 6, of course with the actuator tool 90 removed), to release the holding means 29. The dynamic shock of that impact releases the holding means 29 sufficiently that the spring 42 is able to push the actuator member 26 leftwardly from the switch-open condition, FIGS. 3, 4, and 6, to the switch-closed condition of FIGS. 1,2, and 11.

Economy yet good operativity is achieved by providing that the releasable holding means 29 is by frictional contact, i.e., provided by and between the outer side surfaces 27 of the movable actuator member 26 and the inner side of the carrier member chamber 28.

More particularly, the movable actuator member 26 (FIG. 2) has an outwardly tapering outer side surface 27, which enlarges in the direction which the movable actuator member 26 is being biased by the spring means 42, for frictionally engaging the inner wall of the carrier member chamber 27 for achieving the releasable holding means 29 operativity frictionally without the expense of a more sophisticated interlock mechanism.

As shown, economy and operativity are achieved in spite of the low voltage of the battery 16, by making end 49 with battery-contacting face 50 of the conductive body member 40 to be convex form, the needed good electrical conductivity between face 50 and the battery face 16A also helped by the biasing force of the spring 42.

Overall effectiveness is assured, in the embodiment shown, by the provision of the primary receiving chamber 15 (FIGS. 5 and 6) with a shock-absorbing resilient body 52 adjacent the end 53 of the primary receiving chamber 15 opposite the chamber 15's end 54 to which a screw type cap member 56 is provided, to fit in the open (threaded)end 58 of the main body bore or chamber 15. The closure cap 56 is provided with dimples 59 of the same nature as the overall surface of the ball body 12; and thus when the carrier member 14 (with its full assembly of components) is inserted through the hole-end 58 and into the primary body chamber 15, the device 12 appears almost to be a conventional golf ball. (Note FIG. 6.)

Figure 7:
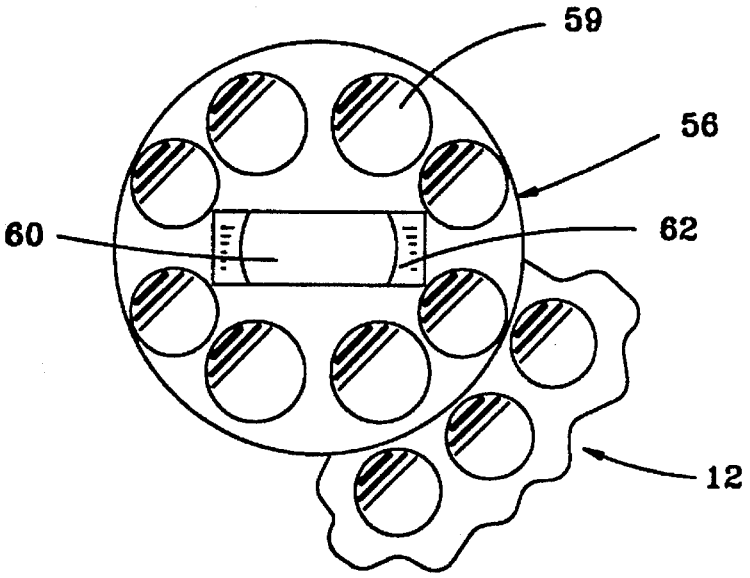
FIG. 7 is an enlarged detail view of a portion of the ball body at and adjacent the end of the ball's bore, illustrating the cap and the fragmental detail of an adjacent portion of the ball body.
Figure 8:
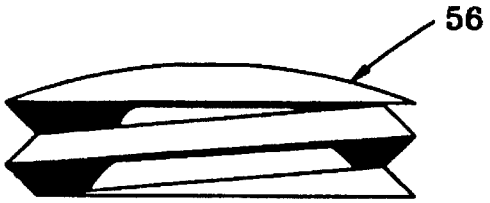
FIG. 8 is an elevation view of the cap shown in the other figures.
Figure 9:
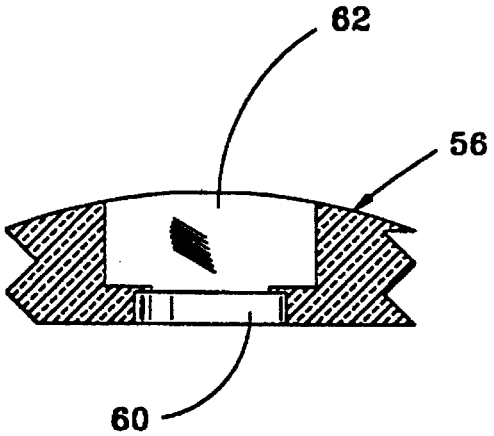
FIG. 9 is a cross-sectional view of the ball-cap as shown in FIG. 7.

Varying from a conventional golf ball, however, the closure cap 56 is provided with two co-axial and adjacent openings, an inner one 60 being cylindrical and another one 62 being a slot for receiving the torque effect in a cap-opening or cap-closing effort; but it is to be noted (FIGS. 7 and 9) that the holes are co-axial, extending completely through the cap 56, thus providing a passage for sound emission as caused by the buzzer 18 in the bore 15.

Figure 5:
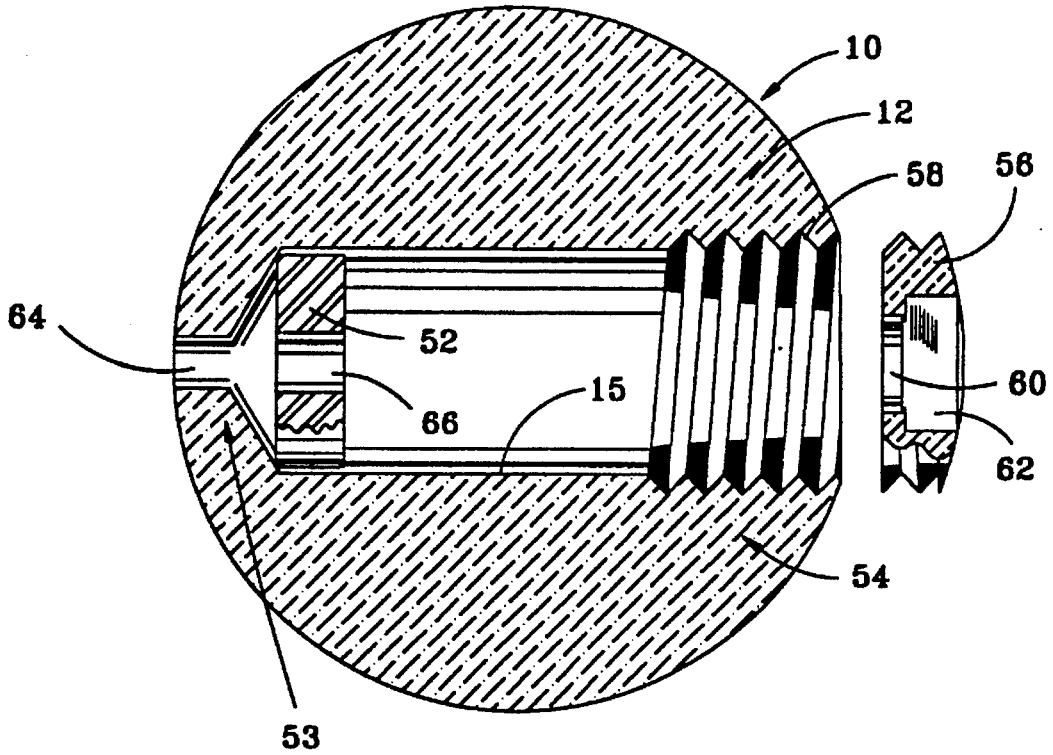
FIG. 5 is a cross-sectional view of the golf ball with a shock-absorber block contained near the end of an inner bore of the ball, and with a cap for the bore being shown as being held adjacent the ball.

Also, not quite of the appearance of a conventional golf ball, the opposite end 53 of the body bore 15 is provided with a small opening 64 extending from the chamber bore 15 to the exterior of the ball body 12, also permitting some passage of sound from the buzzer 18 through the outer hole 64. (FIG. 5)

Achieving the double benefit of release of sound and of access from the outside of the ball body 12 to the inner cap aperture 44 and the movable actuator member 26, the resilient body 52 is provided with an axial opening 66.

It is end 53 of the ball bore 15 which has the aperture or small opening 64 which is the portion of the ball body 12 which is to be struck in the action of hitting the ball arid incidentally initiating the sound-emitting closed circuitry 23 and the sound of the buzzer 18. As the ball is struck in the portion of the access hole 64, it is believed that there is a small amount of compression achieved in the body of the ball 12, and even a small amount of compression in the shock absorber body 52, serving, it is believed, to assist in the release of the holding means 29 and the achievement of the spring 42's moving the actuator body 26 (and its face 46) into circuit-closing contact with the cap 30.

Desirably as shown the conductive body 40 is provided with an integral flange 70 against which the spring means 42 seats and provides electrical conductivity.

Also, as will be noted, the movable actuator member 26 is provided with a recess 72 extending inwardly from what is noted above as being its second face 48; and an end of the spring means 42 is received within the recess 72.

The seating of the spring 42 in the recess 72, together with the seating of the other end of spring 42 against the flange 70, and the axial guidance of an axial hole 74 in which the battery-contacting cylindrical end portion 49 of the conductive body 40 is received, together with the tapering of the mating walls 27/28 of the retention or holding means 29, cooperate to assure that once (FIGS. 3,4,and 6) the retentive holding means 29 has been achieved for sound-silent condition of the buzzer 18, the actuator member 26 is not likely to inadvertently move to a sounding, i.e., the (FIGS. 1,2) switch-closing position of switch 24 (actuator 26's face 46 and the inner cap 30).

Alternatively, the spring 42 may be connected to the conductive member 40's flange 20 and/or also connected at its other end to the actuator member 26's wall 48.

Concluding the description of the ball 12 (FIG. 1), it will be noted that the conductivity means 20 of the buzzer circuit 23 include the wire 78 which passes through adhesive 80 and is connected to the wire or contact plate 82 which runs diametrically of the carrier 14 and is engaged electrically and mechanically by the negative battery terminal 16B, this contact being assisted as mentioned above by the force of the spring 42 acting through the conductive body 40 and the battery 16.

Both of the electrical engagements 16A and 16B with the conductive body nose 50 and the contact strip 82 are of course releasable, as is of course desirable for changing to a new battery 16.

The contact between wire 78 and wire 82, however, is permanent, and is made quite positive by solder 84.

Both of the wires 78 and 82 are sturdily held by both being embedded in the adhesive layer 80, as is also the wire 36's portion 86 of the wire circuitry 22 emerging from the buzzer 18 toward the switch means 24.

Replacement of a battery 16 is easily done by removing the carrier body 14 from the chamber hole 15, as permitted by removal of the cap 56, and then pushing the battery 16 transversely of the carrier body 14.

Figure 10:
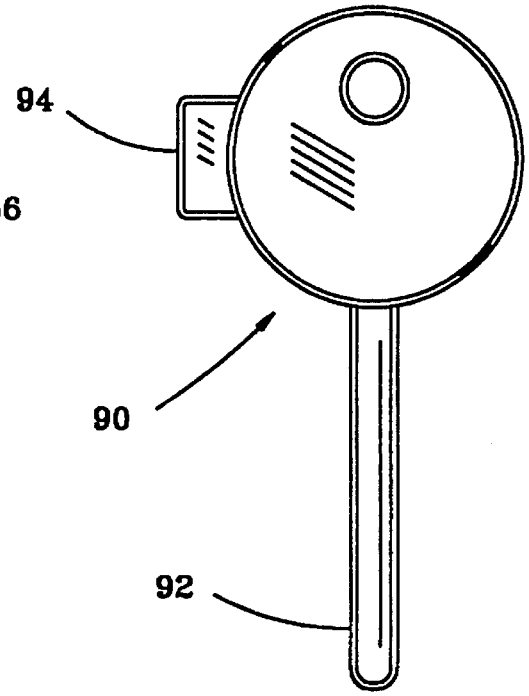
FIG. 10 is a view of an actuator tool whose shaft is shown in the other figures.

For convenience of the user, although any handy article such as a golf tee may be used, there is provided an associated actuator body 90, conveniently molded as a generally flat plastic piece, which provides both an actuator shaft 92 and a screwdriver lug 94. The body is illustrated in FIG. 10.

In use of the tool 90 to silence the buzzer 18 by opening the circuit 23, the shaft 92 is inserted into the interior of the golf ball body 12 through the access opening 64 and shock absorber body hole 66. The shaft 92 is of such a length, that, when so inserted, and then pushed inwardly of the golf ball, it forces the movable actuator member 26 to its position in which the releasable holding means 29 is providing the open-circuit condition of silence of the sound-emitting means 18, the associated actuator body 90 thus providing for the single manual force action of both silencing the buzzer 18 and cocking the releasable holding means 29.

The shaft 92 is desirably longer than that minimum length, however, so that when the cap 56 is removed, the shaft 92 can be pushed far enough into the ball body 12 that the sound emitter body 18 is pushed outwardly of hole 58 at bore-end 54 for ease of the user to withdraw the carrier 14 for replacement and/or servicing, bodies 14 and 18 being connected by adhesive mass 80.

Considering the hole 58's end of the ball bore 15, the outer closure cap 56 is provided with the transverse recess 62 (FIGS. 7, 9) as mentioned above by which the associated tool 90 may achieve rotation of the outer closure cap 56, by manual movement of the tool 90 by a user, which by screwdriver action of the lug 94 serves to provide the rotational torque to the closure cap 56 at hole end 54.

An alternative to the slidability in bore 74 of conductive member 40's nose portion 50 is shown in FIG. 11 (2nd Embodiment).

As shown there, the conductive body member means 40A is a body member supported between the walls of the carrier member 14 and the body chamber wall 15, and-the body means 40A's engagement with the battery 16.

The conductive body member means 40A is formed of metal, providing both strength and electrical conductivity of the circuit 23, between the battery 16 and the adjacent end of the spring means 42, i.e., the end of the spring means 42 opposite its end which engages the movable actuator member 26 for biasing the movable actuator member 26 to closed circuit (here left) position.

An advantage of the FIG. 11 assembly is that the conductive body member means 40A provides that the impact force upon the ball to release the holding operativity of the releasable holding means 29 will not permit the spring means 42 to come into closed-coil condition, yet nevertheless provide that the spring means 42 exerts the circuit-closing force upon the actuator member 26.

More particularly as providing that operativity, the overall assembly of the conductivity means 40A to the spring means 42 comprises the provision of screw threads 46 in the conductive body member means 40A, and a screw 98 whose head operatively engages the screw threads 96. As so assembled, the conductivity means 40A extends transversely far enough that its operative abutment with a transverse wall 100 of the carrier member 14 blocks full coil-closure movement of the body of the spring means 42, regardless of the impact and succession of impacts on the ball during its life.

A further advantage of the FIG. 11 assembly is longevity of the device life for the continued use of the device, whose succession of strikes to initiate the closed-circuit sounding of the buzzer 18 may cause a deformation of the battery 16.

Helping to achieve that longevity, the bias (here rightward) of the spring 42 against the assembly of conductive means 40A and screw 98 biases the conductive body means 40A to push (here rightward) against the battery 16, maintaining sufficient electrical contact with the battery 16 and holding it in its location bearing against contact 82 even if the battery 16 has become deformed due to the striking (here rightward) of the ball.

Summary of Advantages

The present invention as detailed herein has advantages in both concept and in component parts and features; for in contrast to other articles known to the inventors as to the prior art mentioned, the invention provides advantageous features which should be considered, both as to their individual benefit, and to whatever may be considered to be also their synergistic benefit toward the invention as a whole:

(a) Economy of parts;

(b) Economy of assembly;

(c) Positive operability;

(d) Plural function of spring;

(e) Spring bias of switch components;

(f) Spring bias of conductive body to battery;

(g) Spring bias of battery to sound emitter;

(h) Novel retention of open switch;

(i) Spring-loaded cocking feature;

(j) Protector against spring failure; and (k) Actuator spring also serves to bias good electrical contact with both contacts of the battery;

(l) Handy manual actuator tool

Conclusion

It is thus seen that a sound-emitting golf ball device, constructed and used according to the combination of inventive concepts and details herein set forth, provides novel and useful concepts of a desirable and usefully advantageous article, yielding advantages which are and provide special and particular advantages when used as herein set forth.

In summary as to the nature of the overall article's advantageous concepts, their novelty and inventive nature is shown by novel features of concept and construction shown here in advantageous combination and by the novel concepts hereof not only being different from all the prior art known, building on the inventor Barnhill's prior patent U.S. Pat. No. 5,112,055, and even though forms of sound-emitting articles have been known and used for scores of years, but because the achievement is not what is or has been suggested to those of ordinary skill in the art, especially realistically considering this as a novel combination comprising components which individually are similar in effect to what is well known to most all persons, surely including most of the many makers and users of golfing equipment for all those years, throughout the entire world.

Golf's popularity has increased very substantially for at least the last two or three decades; but its widespread play and history, and the widespread knowledge of battery-powered sound-emitting devices, have existed world-wide scores of years; and the prior art has shown a very widespread recognition of the need for a practical and convenient sound-emitting golf ball.

Yet no prior art components or elements have even suggested the modifications of any other prior art to achieve the particulars of the novel concepts of the overall combination here achieved, with the special advantages which the overall combination article provides; and this lack of suggestion by any prior art has been in spite of the long world wide history of various types of sound-emitting articles including golf balls, and the knowledge of natural principles as used in the sound-emitting balls of the present invention.

The differences of concept and construction as specified herein yield advantages over the prior art; and the lack of this invention by the prior art, as a prior art combination of ball and sound system has been in spite of this invention's apparent simplicity of the construction once the concepts have been conceived, in spite of the advantages it would have given, and in spite of the availability of knowledge of the principles, to all persons.

Quite certainly this particular combination of prior art details as here presented in this overall combination has not been suggested by the prior art, this achievement in its particular details and utility being a substantial and advantageous departure from prior art, even though the prior art has known of and used sound-emitting apparatus for many decades. And particularly is the overall difference from the prior art significant when the non-obviousness is viewed by a consideration of the subject matter of this overall article as a whole, as a combination integrally incorporating features different in their combination from the prior art, in contrast to merely separate details themselves, and further in view of the prior art's sound-emitter concepts and devices not achieving particular advantages here achieved by this combination.

Accordingly, it will thus be seen from the foregoing description of the invention according to this illustrative embodiment, considered with the accompanying drawings, that the present invention provides new and useful concepts of a novel and advantageous article, possessing and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments or form or arrangement of parts herein described.

What is claimed is:

1. A golf ball including a sound-emitting device, comprising, in combination:

a carrier member carried by the golf ball interiorly thereof;

a battery;

a sound-emitting means, electrically activatable, and having a first electric circuitry means and a second electric circuitry means which activate the sound-emitting means when impressed with different voltage;

electric circuitry operatively connecting in series the respective ones of the first electric circuitry means and the second electric circuitry means of the sound-emitting means and the battery;

switch means in said circuitry in operative series with the battery and the sound-emitting means' first electric circuitry means and second electric circuitry means;

a movable actuator member movably carried by the carrier member in a chamber provided therein;

an inner cap member connected into an assembly with the carrier member, and having electrically conductive means connected to one of the first electric circuitry means and second electric circuitry means of the sound-emitting means;

the movable actuator member and the carrier member/cap member assembly being relatively movable into and between a sound-silent condition in which the switch means is in an open-circuit condition, and a sound-emitting condition in which the switch means is in a closed-circuit condition;

the switch means comprising a relative movability of the inner cap member's electrically conductive means and the movable actuator member, that relation being such that in a first relative position they are in a closed-circuit operatively touching condition, and providing electrical contact therebetween, and in a second relative position they are operatively in an open-circuit condition not operatively touching, and not providing electrical contact therebetween;

a conductive body member;

a spring means operatively interconnecting the conductive body member and the movable actuator member, and biasing them apart, and biasing the movable actuator member toward a relative position having sound-emitting closed-circuit condition of the switch means, and maintaining that sound-emitting condition until circuit-opening opposing force is applied as specified below;

releasable holding means operative to hold the carrier member/cap member assembly and the movable actuator member in a relative holding position of operative electrical open-circuit non-engagement which releasably maintains the sound-silent condition of the switch means;

the releasable holding means being releasingly operative, by impact force by a golf club upon the ball, to release its said holding operativity, the spring means then being operative, due to the said release by the releasable holding means, to cause the movable actuator member and the carrier member/cap member assembly to move relatively to one another, to operatively electrically engage one another to achieve sound-emitting closed-circuit condition of the switch means;

there being provided a conductor means between the movable actuator member and the conductive body member, serving as a conductor of electrical energy between the movable actuator member and the conductive body member;

the conductive body member operatively electrically engaging the battery;

and the inner cap member is provided with an inner cap aperture which provides operative access through the inner cap member to the movable actuator member for manual force to be operatively applied to the movable actuator member, opposing the bias force of the spring means thereupon, to achieve open-circuit silencing of the sound-emitting means, and also to establish said releasably held holding condition of the releasable holding means to hold and maintain the silence of the sound-emitting means, and also to cock the device for the subsequent impacting of the ball by a golf club to re-start the sound-emitting operativity of the sound-emitting means, by a single manual force impact by the user;

the golf ball being provided with a primary receiving chamber, into which the carrier member is disposed;

in a combination in which the movable actuator member comprises a generally cylindrical body having, as a part of the switch means in said electric circuitry, electrical conductivity means on a first face of the movable actuator member, that being the face thereof which, when the carrier member is disposed in the golf ball, is the movable actuator member's face facing the direction which the movable actuator member is being biased by the said spring means;

the movable actuator member also having electrical conductivity means on a second face thereof, which electrical conductivity means is in electrical conductivity contact with the said conductor means;

and the movable actuator body provides electrical conductivity operatively between the electrical conductivity means on its first and second faces;

the electric circuitry including portions which provide components of the said switch means which are operatively in electrically conductive engagement with the said electrical conductivity means on the said first face of the movable actuator member when the movable actuator member is released from the sound-silent condition of the switch means.

2. The golf ball invention as set forth in claim 1, in a combination in which the releasable holding means comprises a fractional contact provided by and between the outer side surfaces of the movable actuator member and the inner side of the carrier member chamber.

3. The golf ball invention as set forth in claim 2, in a combination in which a face of the conductive body member is of convex form, for achieving good electrical conductivity between it and the battery as the said conductive body member is being biased by the biasing force of the said spring means.

4. The golf ball invention as set forth in claim 1 in a combination in which the movable actuator member is provided to have an outwardly tapering outer side surface which enlarges in the direction which the movable actuator member is being biased by the said spring means, for frictionally engaging the inner wall of the carrier member chamber for achieving the releasable holding means' holding operativity.

5. The golf ball invention as set forth in claim 1, in a combination in which a face of the conductive body member is of convex form, for achieving good electrical conductivity between it and the battery as the said conductive body member is being biased by the biasing force of the said spring means.

6. The golf ball invention as set forth in claim 1, in a combination in which the primary receiving chamber is provided with a resilient body adjacent the primary receiving chamber end to which the inner cap member is adjacent.

7. The golf ball invention as set forth in claim 1, in a combination in which the golf ball is provided with an opening through which the carrier member is insertable into the golf ball's primary receiving chamber, and the opening is provided with a removable outer closure cap.

8. The golf ball invention as set forth in claim 7, in a combination in which the outer closure cap is provided with a hole which provides audible communication of the primary receiving chamber with the exterior of the golf ball even though the closure cap operatively covers the said opening.

9. The golf ball invention as set forth in claim 7, in a combination in which the closure cap is provided to have a surface substantially identical to the portions of the ball's surface other than its surface portion which provides the opening to which the cap covers.

10. The golf ball invention as set forth in claim 7, in a combination in which the golf ball is also provided with an access aperture adjacent the end of the primary receiving chamber to which the inner cap member is adjacent; and there is also provided an associated actuator body which is provided with a shaft member which is insertable into the interior of the golf ball by extending through said access aperture, and the shaft member is of a length such that, when so inserted, and then moved to extend further inwardly of the golf ball, the shaft member operatively engages the movable actuator member and moves the movable actuator member to a position in which the releasable holding means is providing open-circuit condition of silence of the sound-emitting means, and the releasable holding means is cocked for re-starting sound-emitting operativity, the said associated actuator body thus providing for the said single manual force action;

the outer closure cap being provided with a transverse recess by which the associated actuator body may achieve rotation of the closure cap by manual rotational movement of the associated actuator body by a user;

and said associated actuator body is provided with a torque-imposing body portion by which the outer closure cap may be rotated;

said associated actuator body, as a single associated tool, thus providing for and accommodating operativity of both the rotational opening and closure of the outer closure cap, as well as providing the actuation of the movable actuator member and its releasable holding means to move to open-circuit sound-silent condition of the switch means.

11. The golf ball invention as set forth in claim 10, in a combination in which the said shaft is of a length which exceeds the distance from the exterior of the ball at the location of the body aperture to the adjacent face of the movable actuator member, when the carrier member and sound-emitting means are disposed within the primary receiving chamber.

12. The golf ball invention as set forth in claim 11, in a combination in which the primary receiving chamber is provided with a resilient body disposed at the end of the primary receiving chamber adjacent the body aperture, the resilient body being provided with an axial opening, and the length of the shaft also including the length of the axial opening of the resilient body.

13. The golf ball invention as set forth in claim 1, in a combination in which the inner cap member is formed from metal, and integrally provides its said electrically conductive means and a contact with the movable actuator member and electrical conductivity means therebetween.

14. The golf ball invention as set forth in claim 1, in a combination in which the said spring means provides the said conductor means which serves as the said electrical conductivity means.

15. The golf ball invention as set forth in claim 14 in a combination in which the conductive body member is formed from metal, and integrally provides electrical contact with the spring means and with the battery.

16. The golf ball invention as set forth in claim 15, in a combination in which the conductive body is provided with an integral flange against which the spring means seats and provides electrical conductivity therebetween.

17. The golf ball invention as set forth in claim 1, in a combination in which the movable actuator member is provided with a recess extending inwardly of its said second face, an end of the spring means being received within the said recess.

18. The golf ball invention as set forth in claim 1, in a combination in which the spring means is fixedly connected to both the conductive body member and movable actuator member.

19. A golf ball including a sound-emitting device, comprising, in combination:

a carrier member carried by the golf ball interiorly thereof;

a battery;

a sound-emitting means, electrically activatable, and having a first electric circuitry means and a second electric circuitry means which activate the sound-emitting means when impressed with different voltage;

electric circuitry operatively connecting in series the respective ones of the first electric circuitry means and the second electric circuitry means of the sound-emitting means and the battery;

switch means in said circuitry in operative series with the battery and the sound-emitting means' first electric circuitry means and second electric circuitry means;

a movable actuator member movably carried by the carrier member in a chamber provided therein;

an inner cap member connected into an assembly with the carrier member, and having electrically conductive means connected to one of the first electric circuitry means and second electric circuitry means of the sound-emitting means;

the movable actuator member and the carrier member/cap member assembly being relatively movable into and between a sound-silent condition in which the switch means is in an open-circuit condition, and a sound-emitting condition in which the switch means is in a closed-circuit condition;

the switch means comprising a relative movability of the inner cap member's electrically conductive means and the movable actuator member, that relation being such that in a first relative position they are in a closed-circuit operatively touching condition, and providing electrical contact therebetween, and in a second relative position they are operatively in an open-circuit condition not operatively touching, and not providing electrical contact therebetween;

a conductive body member means abuttingly engageable with the carrier member;

a spring means operatively affixed to the conductive body member means, and engaging the movable actuator member, and biasing the movable actuator member toward a relative position having sound-emitting closed-circuit condition of the switch means, and maintaining that sound-emitting condition until circuit-opening opposing force is applied as specified below;

releasable holding means operative to hold the carrier member/cap member assembly and the movable actuator member in a relative holding position of operative electrical open-circuit non-engagement which releasably maintains the sound-silent condition of the switch means;

the releasable holding means being releasingly operative, by impact force by a golf club upon the ball, to release its said holding operativity, the spring means then being operative, due to the said release by the releasable holding means, to cause the movable actuator member and the carrier member/cap member assembly to move relatively to one another, to operatively electrically engage one another to achieve sound-emitting closed-circuit condition of the switch means;

there being provided a conductor means between the movable actuator member and the conductive body member means, serving as a conductor of electrical energy between the movable actuator member and the conductive body member means;

the conductive body member means operatively electrically engaging the battery;

and the inner cap member is provided with an inner cap aperture which provides operative access through the inner cap member to the movable actuator member for manual force to be operatively applied to the movable actuator member, opposing the bias force of the spring means thereupon, to achieve open-circuit silencing of the sound-emitting means, and also to establish said releasably held holding condition of the releasable holding means to hold and maintain the silence of the sound-emitting means, and also to cock the device for the subsequent impacting of the ball by a golf club to re-start the sound-emitting operativity of the sound-emitting means, by a single manual force impact by the user;

the golf ball being provided with a primary receiving chamber, into which the carrier member is disposed;

in a combination in which the movable actuator member comprises a generally cylindrical body having, as a part of the switch means in said electric circuitry, electrical conductivity means on a first face of the movable actuator member, that being the face thereof which, when the carrier member is disposed in the golf ball, is the movable actuator member's face facing the direction which the movable actuator member is being biased by the said spring means;

the movable actuator member also having electrical conductivity means on a second face thereof, which electrical conductivity means is in electrical conductivity contact with the said conductor means;

and the movable actuator body provides electrical conductivity operatively between the electrical conductivity means on its first and second faces;

the electric circuitry including portions which provide components of the said switch means which are operatively in electrically conductive engagement with the said electrical conductivity means on the said first face of the movable actuator member when the movable actuator member is released from the sound-silent condition of the switch means;

the affixing of the spring means to the conductive body member means, and abutting engagement of the conductive body member means with the carrier member, providing that the impact force upon the ball to release the holding operativity of the releasable holding means will not permit the spring means to come into closed-coil condition, yet nevertheless provide that the spring means exerts the circuit-closing force upon the actuator member.

20. The golf ball invention as set forth in claim 19, in a combination in which the affixing of the spring means operatively to the conductive body member means comprises the provision of screw threads in the conductive body member means, and a screw whose head operatively engages the spring means, and whose threaded shank operatively engages said screw threads, and the conductive body member means is supported so as to abuttingly engage the carrier member.

21. The golf ball invention as set forth in claim 20, in a combination in which the spring means is such that its bias against the assembly of conductive body means and screw biases the conductive body means to push against the battery, maintaining sufficient electrical contact with the battery and holding it in its contact location even if the battery has become deformed.

22. The golf ball invention as set forth in claim 19, in a combination in which the battery is one having two contact faces and is supported such that its two contact faces are operatively aligned, respectively, with a contact member provided as one of the terminals of the sound-emitting means, and with the conductive body member means, the bias of the spring means against the conductive body means serving also to assure good electrical contact of both of the battery faces.

23. The golf ball invention as set forth in claim 19, in a combination in which the releasable holding means comprises a fractional contact provided by and between the outer side surfaces of the movable actuator member and the inner side of the carrier member chamber.

24. The golf ball invention as set forth in claim 19, in a combination in which the said spring means provides the said conductor means which serves as the said electrical conductivity means.

* * * * *